US010707628B2

(12) United States Patent
Iizuka et al.

(10) Patent No.: US 10,707,628 B2
(45) Date of Patent: Jul. 7, 2020

(54) NOISE FILTER AND NOISE REDUCTION UNIT

(71) Applicant: Yazaki Corporation, Minato-ku, Tokyo (JP)

(72) Inventors: Hayato Iizuka, Kakegawa (JP); Kazuma Kayo, Kakegawa (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/947,093

(22) Filed: Apr. 6, 2018

(65) Prior Publication Data

US 2018/0301854 A1 Oct. 18, 2018

(30) Foreign Application Priority Data

Apr. 17, 2017 (JP) ..... 2017-081490

(51) Int. Cl.

| | |
|---|---|
| ***H01R 13/7193*** | (2011.01) |
| ***H01F 17/04*** | (2006.01) |
| ***H01F 17/06*** | (2006.01) |
| ***H01F 27/02*** | (2006.01) |

(52) U.S. Cl.

CPC ..... *H01R 13/7193* (2013.01); *H01F 17/041* (2013.01); *H01F 17/062* (2013.01); *H01F 27/027* (2013.01); *H01F 2017/065* (2013.01)

(58) Field of Classification Search

CPC .. H01R 13/7193; H01R 13/719; H01R 24/42; H01F 17/041; H01F 17/062; H01F 27/027; H01F 2017/065; H01F 27/29; H01F 27/2847; H01F 27/2823; H01F 27/24; H01F 27/022; H01F 27/02

USPC ..... 439/620.05, 620.13

See application file for complete search history.

(56) References Cited

U.S. PATENT DOCUMENTS

| | | | | |
|---|---|---|---|---|
| 4,964,012 | A | 10/1990 | Kitagawa | |
| 5,343,184 | A | 8/1994 | Matsui et al. | |
| 5,982,253 | A * | 11/1999 | Perrin | H01R 13/719 333/182 |
| 6,196,371 | B1 * | 3/2001 | Martin | G07D 3/06 194/317 |
| 8,035,472 | B2 * | 10/2011 | Vail | H01F 3/14 336/212 |

(Continued)

FOREIGN PATENT DOCUMENTS

| | | |
|---|---|---|
| GB | 2256532 A | 12/1992 |
| JP | S51-009216 U | 1/1976 |

(Continued)

OTHER PUBLICATIONS

Sep. 19, 2018—(EP) Extended Search Report—App 18166520.9.
May 7, 2019—(JP) Notice of Reasons for Refusal—App 2017-081490.

*Primary Examiner* — Travis S Chambers
(74) *Attorney, Agent, or Firm* — Banner & Witcoff, Ltd.

(57) ABSTRACT

A noise filter including a conductor and an annular core. The conductor has a wound portion. The annular core is formed of a magnetic material and passes through the wound portion. The annular core is formed of a pair of split cores that are assembled together with joining surfaces on both ends to be joined to each other. At least one of a recess portion and a projection portion that engage with each other is formed on the joining surfaces of the split cores which are joined to each other.

9 Claims, 7 Drawing Sheets

(56) References Cited

U.S. PATENT DOCUMENTS

| | | | | |
|---|---|---|---|---|
| 8,749,335 | B2 * | 6/2014 | Ueno | H01F 37/00 336/178 |
| 9,183,981 | B2 * | 11/2015 | Ueno | H01F 37/00 |
| 9,478,346 | B2 * | 10/2016 | Nakata | H01F 27/06 |
| 9,508,468 | B2 | 11/2016 | Nakatani et al. | |
| 10,355,372 | B2 * | 7/2019 | Iizuka | H01B 1/22 |
| 10,355,418 | B2 * | 7/2019 | Iizuka | H01R 13/658 |
| 10,468,832 | B2 * | 11/2019 | Iizuka | H01R 13/646 |
| 2011/0006870 | A1 * | 1/2011 | Sakamoto | H01F 1/26 336/221 |
| 2011/0115593 | A1 * | 5/2011 | Liao | H01F 27/02 336/90 |
| 2012/0146759 | A1 * | 6/2012 | Shibuya | H01F 17/043 336/221 |
| 2015/0235738 | A1 | 8/2015 | Nakatani et al. | |
| 2018/0047492 | A1 * | 2/2018 | Sakai | H01F 27/02 |
| 2018/0374634 | A1 * | 12/2018 | Iizuka | H01F 27/33 |

FOREIGN PATENT DOCUMENTS

| | | | | |
|---|---|---|---|---|
| JP | S53-029245 | U | | 3/1978 |
| JP | 62176211 | A | * | 8/1987 |
| JP | H01-196106 | A | | 8/1989 |
| JP | H05-001205 | U | | 1/1993 |
| JP | H08-181479 | A | | 7/1996 |
| JP | H10-107571 | A | | 4/1998 |
| JP | 2000-353622 | A | | 12/2000 |
| JP | 2005-011962 | A | | 1/2005 |
| JP | 2006332475 | A | * | 12/2006 |
| JP | 4369167 | B2 | | 11/2009 |
| JP | 2015-153735 | A | | 8/2015 |
| KR | 10-2008-0067914 | A | | 7/2008 |

* cited by examiner

NOISE FILTER AND NOISE REDUCTION UNIT

CROSS-REFERENCES TO RELATED APPLICATIONS

This application is based on and claims priority from Japanese Patent Applications No. 2017-081490 filed on Apr. 17, 2017, the entire contents of which are incorporated herein by reference.

BACKGROUND

1. Field of the Invention

The invention relates to a noise filter and a noise reduction unit.

2. Description of Related Art

JP-B2-4369167 discloses a noise filter that reduces noise such as a surge current flowing through electric wire. The noise filter includes an annular core that is formed of a circular magnetic material and has a through hole through which electric wire passes. The annular core is formed by assembling a pair of split cores together.

According to the noise filter of JP-B2-4369167, in a case where misalignment occurs between the split cores, a cross-sectional area forming an annular magnetic path decreases at a joint portion between the split cores. As a result, impedance characteristics deteriorate due to a decrease in magnetic flux in the magnetic path, and thus a noise reduction effect deteriorates.

SUMMARY

One or more embodiments of the invention relates to a noise filter capable of obtaining a satisfactory noise reduction effect and having excellent assembly workability, and also to a noise reduction unit including the noise filter.

In accordance with one or more embodiments, a noise filter including a conductor and an annular core. The conductor has a wound portion. The annular core is formed of a magnetic material and passes through the wound portion. The annular core is formed of a pair of split cores that are assembled together with joining surfaces on both ends to be joined to each other. At least one of a recess portion and a projection portion that engage with each other is formed on the joining surfaces of the split cores which are joined to each other.

Other aspects and advantages of the invention will be apparent from the following description and the appended claims.

DETAILED DESCRIPTION

Exemplary embodiments and modifications thereof will be described with reference to the drawings.

Figure 1:
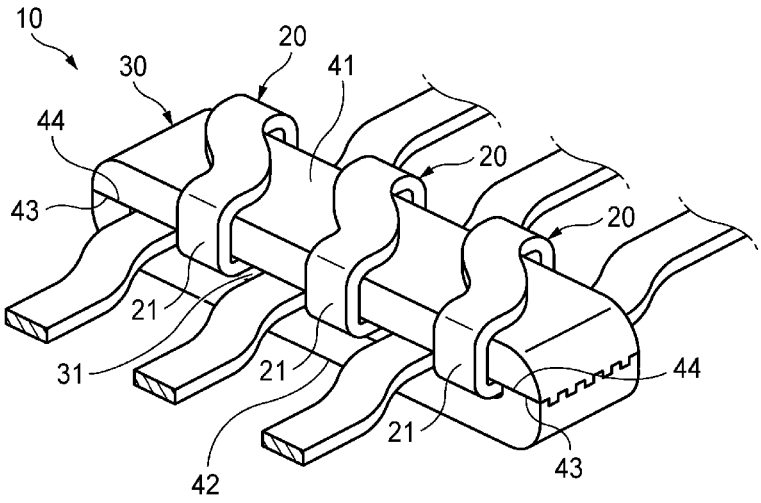
FIG. 1 is a perspective view illustrating a noise filter according to an exemplary embodiment.
Figure 2:
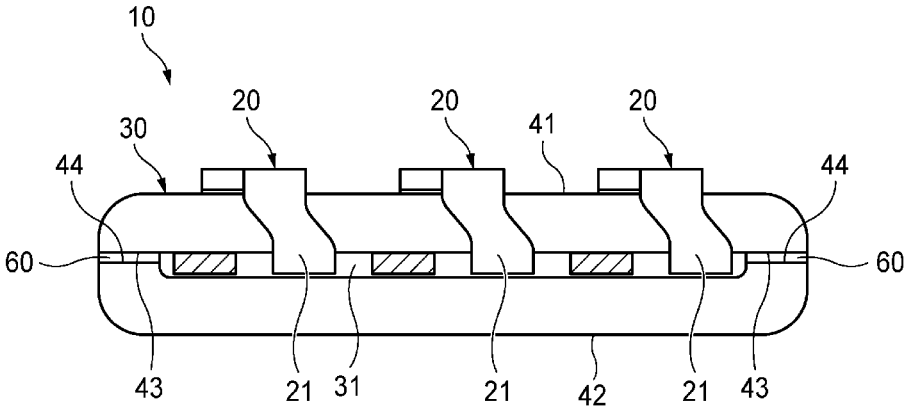
FIG. 2 is a side view illustrating the noise filter.

FIG. 1 is a perspective view illustrating a noise filter according to an exemplary embodiment. FIG. 2 is a side view illustrating the noise filter according to the exemplary embodiment.

As illustrated in FIGS. 1 and 2, the noise filter 10 includes plural (in the example, three) conductors 20 and an annular core 30. The noise filter 10 is, for example, attached to a wire harness through which an inverter and a motor of an electric vehicle, a hybrid vehicle, or the like are connected to each other. The inverter converts a direct current of a power supply such as a battery into an alternating current for driving the motor that rotates wheels. The inverter converts a direct current into an alternating current by switching at a high speed. Therefore, a high-frequency surge current as a noise generated by switching may flow through electric wire of the wire harness. By providing the noise filter 10 in the wire harness between the inverter and the motor, the noise generated by switching is reduced.

The conductor 20 is made of a flat bus bar. The conductor 20 is formed in a strip shape by performing punching or the like on a conductive metal plate. An intermediate portion of the conductor 20 is formed as a wound portion 21 that is wound in an annular shape by bending or the like. The wound portion 21 is wound to protrude upward. The wound portion 21 is obliquely inclined in a plan view. As a result, positions of both end portions of the wound portion 21 are shifted and separated not to be in contact with each other in a plan view.

The annular core 30 is formed of, for example, a magnetic material such as ferrite. The annular core 30 is formed in a flat annular shape that has a passage 31 formed of an elongated hole. The passage 31 of the annular core 30 has a height that is slightly larger than the thickness of the conductor 20.

The annular core 30 is formed of a pair of split cores 41, 42. The split cores 41, 42 are vertically arranged and assembled together to form the annular core 30 having a flat shape that has the passage 31.

Each of the split cores 41, 42 is formed to be linear. At one 41 of the split cores that is disposed on the upper side, plural conductors 20 are arranged in a row in state where they are wound around the split core 41. In each of the conductors 20 wound around the split core 41, both end portions of the wound portion 21 are inserted into the passage 31.

Surfaces of both ends of the one 41 of the split cores facing the other 42 of the split cores are joining surfaces 43. Surfaces of both ends of the other 42 of the split cores facing the one 41 of the split cores are joining surfaces 44. The both ends of the other 42 of the split cores protrudes toward the one 41 of the split cores 41, and the protruding end surfaces are the joining surfaces 44.

Figure 3:
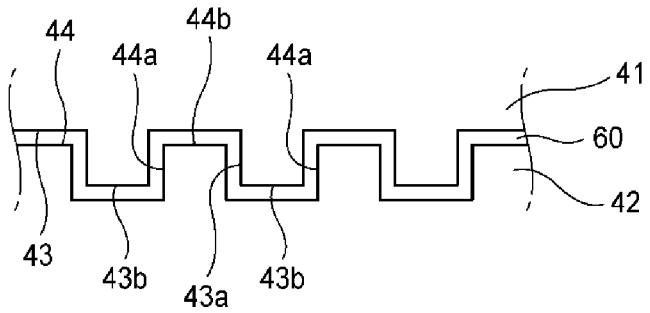
FIG. 3 is side view illustrating an annular core when seen from an end surface side.

FIG. 3 is a side view illustrating the annular core when seen from an end surface side.

As illustrated in FIG. 3, on the joining surfaces 43 of the one 41 of the split cores, recess portions 43*a* formed of plural grooves are formed at intervals, and projection portions 43*b* formed of plural ridges are formed between the respective recess portions 43*a*. The recess portions 43*a* and the projection portions 43*b* are arranged in a width direction of the split core 41. On the joining surfaces 44 of the other 42 of the split cores, recess portions 44*a* formed of plural grooves are formed at intervals, and projection portions 44*b* formed of plural ridges are formed between the respective recess portions 44*a*. The recess portions 44*a* and the projection portions 44*b* are arranged in a width direction of the other 42 of the split cores.

The split cores 41, 42 are joined to each other by bringing the joining surfaces 43, 44 into contact with each other. In this state, the projection portions 44*b* of the joining surfaces 44 of the other 42 of the split cores are fitted into the recess portions 43*a* of the joining surfaces 43 of the one 41 of the split cores, and the projection portions 43*b* of the joining surfaces 43 of the one 41 of the split cores are fitted into the recess portions 44*a* of the joining surfaces 44 of the other 42 of the split cores.

In addition, an adhesive member 60 formed of an adhesive or an adhesive sheet is provided between the joining surfaces 43, 44 of the split cores 41, 42. The joining surfaces 43, 44 of the split cores 41, 42 are adhered and fixed to each other by the magnetic adhesive member 60. The adhesive member 60 is magnetized by including a magnetic material such as ferrite powder. As a result, in the annular core 30, an annular magnetic path is formed by the split cores 41, 42 that are adhered and fixed to each other.

Assembly of the noise filter 10 having the above-described configuration will be described.

Figure 4:
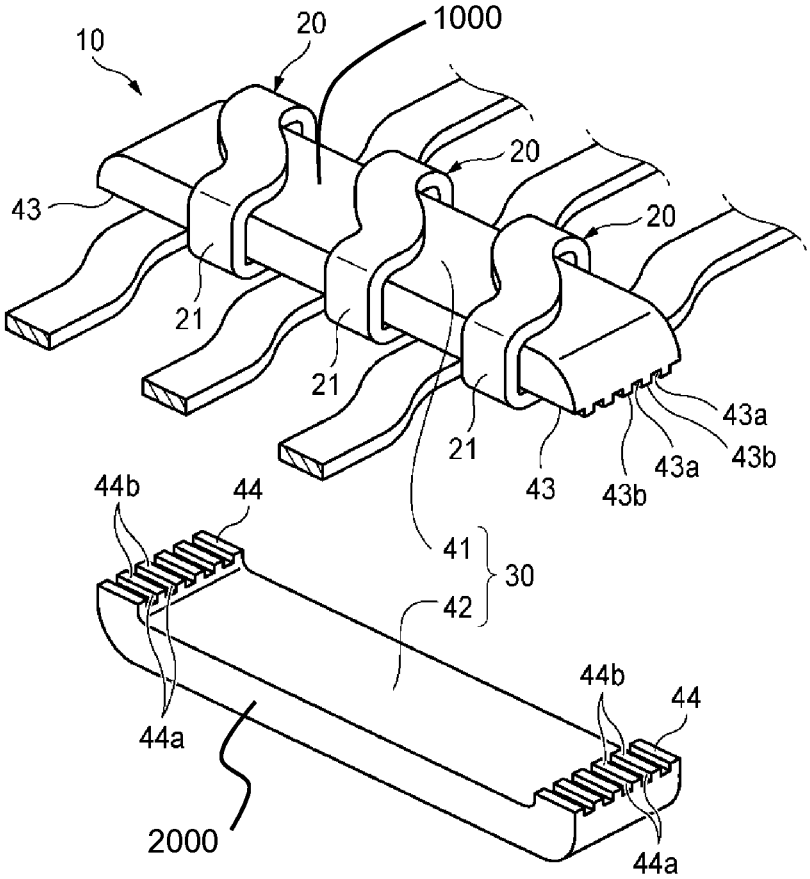
FIG. 4 is an exploded perspective view illustrating the noise filter.

FIG. 4 is an exploded perspective view illustrating the noise filter according to the exemplary embodiment.

In order to assemble the noise filter 10, first, plural conductors 20 including the wound portion 21 are prepared.

Next, as illustrated in FIG. 4, the plural conductors 20 are mounted on a first body portion 1000 of the one 41 of the split cores constituting the annular core 30. Specifically, the first body portion 1000 of the one 41 of the split cores is inserted into the wound portion 21 of each of the conductors 20 positioned such that the wound portions 21 direct upward. As a result, the conductors 20 are arranged in a row in a state where they are wound around the first split core 41.

Next, the joining surfaces 43, 44 of the split cores 41, 42 are brought into contact with each other. As a result, the projection portions 44*b* of the joining surfaces 44 of the other 42 of the split cores are fitted into the recess portions 43*a* of the joining surfaces 43 of the one 41 of the split cores, and the projection portions 43*b* of the joining surfaces 43 of the one 41 of the split cores are fitted into the recess portions 44*a* of the joining surfaces 44 of the other 42 of the split cores. Thus, the split cores 41, 42 are joined to each other in a state where the first body portion 1000, disposed between joining surfaces 43, and second body portion 2000, disposed between joining surfaces 44, are aligned.

In a case where the split cores 41, 42 are assembled together, the adhesive member 60 is applied to either or both of the joining surfaces 43, 44 of the split cores 41, 42. As a result, the joining surfaces 43, 44 of the split cores 41, 42 are adhered to each other by the adhesive member 60 such that the split cores 41, 42 are integrated into the annular core 30.

As a result, the noise filter 10 in which the plural conductors 20 are mounted on the annular core 30 formed of the pair of split cores 41, 42 is obtained. In the noise filter 10 obtained as described above, when a current flows through the conductors 20, noise can be reduced by the annular core 30 having an annular magnetic path.

As described above, in the noise filter 10 according to the exemplary embodiment, by bringing the recess portions 43*a*, 44*a* and the projection portions 43*b*, 44*b* of the joining surfaces 43, 44 of the split cores 41, 42 into contact with each other, the split cores 41, 42 can be easily aligned and joined to each other to form the annular core 30. As a result, deterioration of impedance characteristic caused by misalignment of the joining surfaces 43, 44 can be suppressed, a satisfactory noise reduction effect can be obtained, and assembly workability can be improved.

In addition, the split cores 41, 42 are assembled together in a state where the split core 41 formed to be linear passes through the wound portions 21 of the plural conductors 20. As a result, the plural conductors 20 can be easily mounted on the annular core 30, and assembly workability can be further improved. Further, the noise filter 10 has the structure in which the plural conductors 20 are arranged in a row in the linear split core 41. Therefore, a height of the noise filter 10 can be reduced, and the noise filter 10 can be installed in a narrow space.

In addition, an annular and continuous magnetic path can be reliably formed by fixing the joining surfaces 43, 44 of the split cores 41, 42 to each other using the magnetic adhesive member 60, and a satisfactory noise reduction effect can be obtained. Further, even in a case where the adhesive member 60 having fluidity is used, the adhesive member 60 remains in the recess portions 43*a*, 44*a* of the joining surfaces 43, 44. Therefore, the joining operation of the split cores 41, 42 can be easily performed.

The conductor 20 of the noise filter 10 is not limited to a bus bar and may be insulated wire in which a core is covered with a jacket.

In addition, in the annular core 30, at least the one 41 of the split cores that passes through the wound portions 21 of the conductors 20 only has to be linear, and the other 42 of the split cores is not necessarily linear and may have a curved shape or the like.

In addition, in the example of the exemplary embodiment, the annular core 30 has the configuration in which the pair of split cores 41, 42 that are vertically split are assembled together. The annular core 30 may have a configuration in which a pair of split cores that are horizontally split are assembled together. Even in this case, by forming recess portions and projection portions engaging with each other on joining surfaces of the respective split cores, the noise filter 10 capable of obtaining a satisfactory noise reduction effect and having excellent assembly workability can be obtained.

Next, a noise reduction unit including the noise filter 10 will be described.

Figure 5:
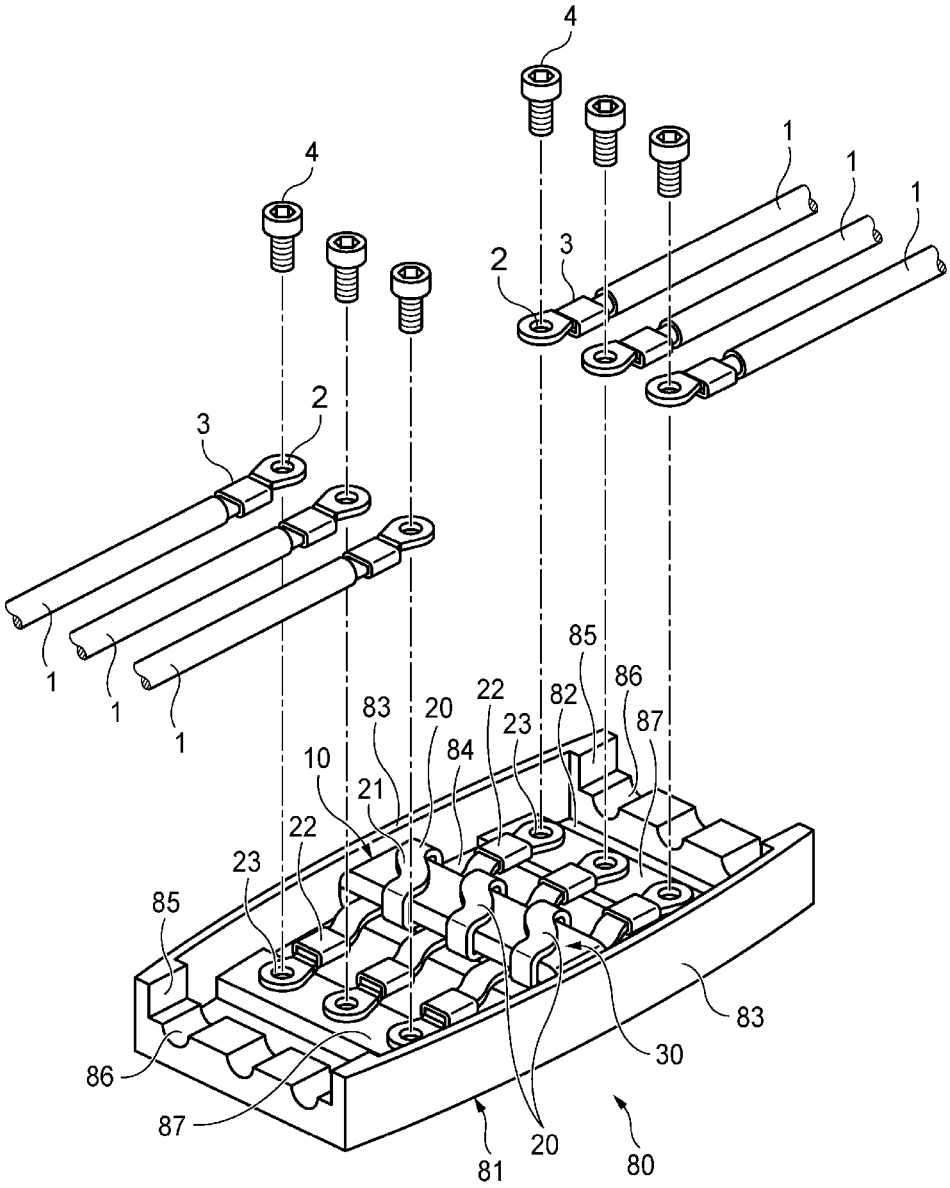
FIG. 5 is a perspective view illustrating a noise reduction unit including the noise filter.

FIG. 5 is a perspective view illustrating the noise reduction unit including the noise filter.

As illustrated in FIG. 5, the noise reduction unit 80 includes a housing 81, and the noise filter 10 is accommodated in the housing 81.

The housing 81 is formed of an insulating synthetic resin, and includes a bottom plate portion 82 and side wall portions 83 that vertically extend from both side portions of the bottom plate portion 82. The housing 81 is formed in a rectangular box shape having an upwardly open accommodation space. In the housing 81, a core holding portion 84 is provided at the center of the accommodation space, and the noise filter 10 is accommodated in the core holding portion 84. Terminals 22 are fixed to both ends of the conductors 20 in the noise filter 10 accommodated in the housing 81. Each of the terminals 22 has a bolt through hole 23 is fixed to the conductor 20 by pressure bonding or the like and is electrically connected to the conductor 20.

Wire introducing portions 85 are provided in both end portions of the housing 81, and electric wires 1 of a wire harness are introduced from the wire introducing portions 85. In each of the wire introducing portions 85, a U-shaped wire holding groove 86 is formed. In addition, a terminal block 87 is provided between each of the wire introducing portions 85 and the core holding portion 84. In the terminal blocks 87, for example, insert nuts (not illustrated) are embedded by insert molding. The terminals 22 fixed to the conductors 20 of the noise filter 10 are disposed over the terminal blocks 87, and each of the terminals 22 is disposed over each of the insert nuts.

The electric wires 1 of the wire harness extending from an inverter and a motor are connected to the noise reduction unit 80 having the above-described configuration. Terminals 3 having a bolt through hole 2 at an end portion thereof are connected to the electric wires 1. The electric wires 1 are routed from the wire introducing portions 85 in the housing 81 and are disposed and held in the wire holding grooves 86. The terminals 3 of the electric wires 1 are disposed to overlap the terminals 22 of the conductors 20 disposed over the terminal blocks 87. As a result, the bolt through holes 2, 23 are connected to each other. In this state, bolts 4 are inserted into the bolt through holes 2, 23 connected to each other, and are screwed into the insert nuts of the terminal blocks 87. As a result, the terminals 3 of the electric wires 1 and the terminals 22 of the conductors 20 of the noise filter 10 are fastened and fixed to the terminal blocks 87 so as to be electrically connected to each other. As a result, the electric wires 1 of the wire harness extending from the inverter and the motor are connected to the noise reduction unit 80, and noise generated by high-speed switching in the inverter can be reduced by the noise filter 10 of the noise reduction unit 80.

This way, for example, the noise reduction unit 80 including the noise filter 10 is attached to, for example, a portion in the middle of the wire harness extending from the inverter and the motor. As a result, noise generated by high-speed switching in the inverter can be satisfactorily reduced. In addition, the noise filter 10 in which the height is suppressed is accommodated in the housing 81. As a result, a reduction in height can be realized, and the noise reduction unit 80 can be provided in a narrow space. Thus, the noise reduction unit can be fixed to a floor panel of a vehicle by being attached to a portion in the middle of a wire harness of the vehicle or the like. In addition, the noise filter 10 including the annular core 30 formed of a magnetic material can be protected by the housing 81.

The housing 81 of the noise reduction unit 80 is filled with a sealant (not illustrated) formed of a synthetic resin such as an epoxy resin. This way, by filling the housing 81 with the sealant, the noise filter 10 including the annular core 30 formed of a magnetic material can be reliably fixed and protected, and impact resistance can be improved. Further, it is not necessary to design a complex waterproof structure, and a reduction in size can be realized. In addition, by attaching a lid to the upper side of the housing 81, waterproofness of the noise reduction unit 80 can be further improved and can be provided outside of a vehicle body.

The invention is not limited to the above example of the exemplary embodiment, and appropriate modifications, improvements, and the like can be made. The material, shape, dimension, number, arrangement position, and the like of each of the components according to the exemplary embodiment are arbitrary and are not particularly limited as long as the invention can be practiced.

For example, the annular core 30 constituting the noise filter 10 is not limited to that of the above example of the exemplary embodiment.

Here, examples of modified exemplary embodiments of the noise filter 10 will be described.

Modified Exemplary Embodiment 1

Figure 6:
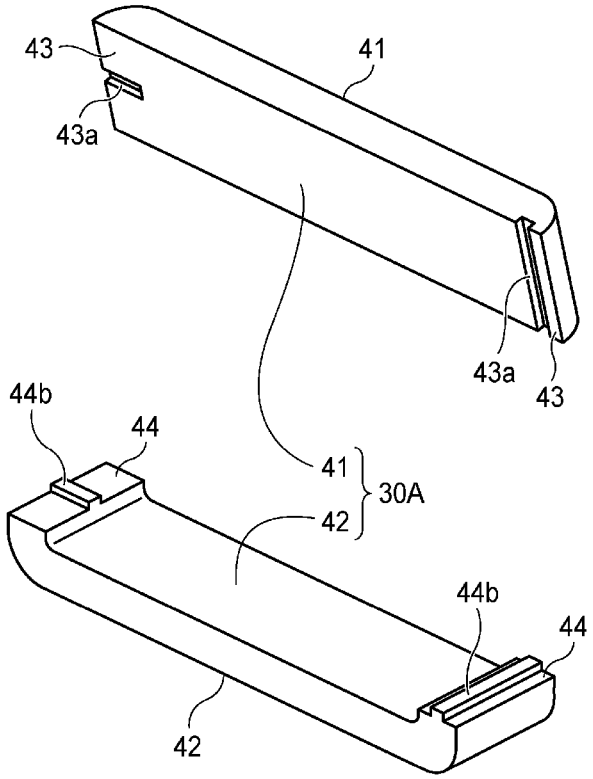
FIG. 6 is an exploded perspective view illustrating an annular core according to a modified exemplary embodiment 1.

FIG. 6 is an exploded perspective view illustrating an annular core according to Modified Exemplary Embodiment 1.

As illustrated in FIG. 6, in an annular core 30A according to the Modified Exemplary Embodiment 1, a recess portion 43*a* formed of a groove is formed on each of the joining surfaces 43 of the one 41 of the split cores, and a projection portion 44*b* formed of a ridge is formed on each of the joining surfaces 44 of the other 42 of the split cores.

Among the recess portions 43*a* formed on the respective joining surfaces 43 of the one 41 of the split cores, one recess portion 43*a* is formed along the width direction of the one 41 of the split cores, the other recess portion 43*a* is formed along a longitudinal direction of the one 41 of the split cores. In addition, among the projection portions 44*b* formed on the respective joining surfaces 44 of the other 42 of the split cores, one projection portion 44*b* is formed along the width direction of the other 42 of the split cores, the other recess portion 44*b* is formed along a longitudinal direction of the other 42 of the split cores.

In the annular core 30A according to Modified Exemplary Embodiment 1, by bringing the split cores 41, 42 into contact with each other, the recess portions 43*a* of the joining surfaces 43 and the projection portions 44*b* of the joining surfaces 44 are fitted to each other such that the split cores 41, 42 are aligned. At this time, directions of the recess portions 43*a* of the joining surfaces 43 of the one 41 of the split cores are different from each other in an orthogonal direction, and directions of the projection portions 44*b* of the joining surfaces 44 of the other 42 of the split cores are different from each other in an orthogonal direction. Accordingly, by bringing the split cores 41, 42 into contact with each other, the split cores 41, 42 are aligned in both the width direction and the longitudinal direction.

This way, in the annular core 30A according to Modified Exemplary Embodiment 1, the split cores 41, 42 are aligned in the plural directions by the recess portions 43*a* and the projection portions 44*b* that engage with each other on the joining surfaces 43, 44 of the both ends of the split cores 41, 42. Accordingly, the split cores 41, 42 can be aligned with higher accuracy, a satisfactory noise reduction effect can be obtained, and assembly workability can be further improved.

Modified Exemplary Embodiment 2

Figure 7:
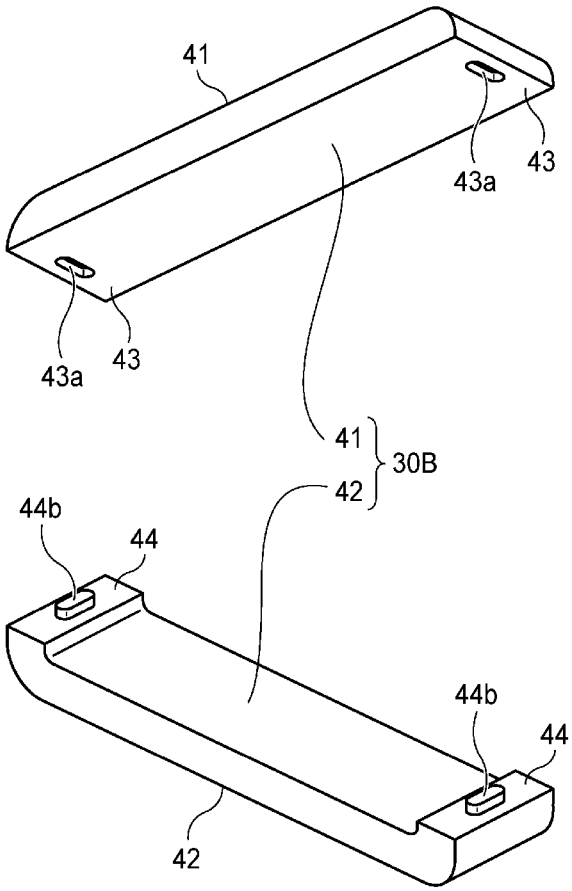
FIG. 7 is an exploded perspective view illustrating an annular core according to a modified exemplary embodiment 2.

FIG. 7 is an exploded perspective view illustrating an annular core according to Modified Exemplary Embodiment 2.

As illustrated in FIG. 7, in an annular core 30B according to Modified Exemplary Embodiment 2, a recess portion 43*a* formed of a hole is formed on each of the joining surfaces 43 of the one 41 of the split cores, and a projection portion

44*b* formed of a protrusion is formed on each of the joining surfaces 44 of the other 42 of the split cores.

In the annular core 30B according to Modification Example 2, by bringing the split cores 41, 42 into contact with each other, the recess portions 43*a* of the joining surfaces 43 and the projection portions 44*b* of the joining surfaces 44 are fitted to each other such that the split cores 41, 42 are aligned in a direction perpendicular to the joining direction.

This way, in the annular core 30B according to Modified Exemplary Embodiment 2, by engaging the projection portions 44*b* formed of a protrusion with the recess portions 43*a* formed of a hole, the split cores 41, 42 can be aligned with higher accuracy, a satisfactory noise reduction effect can be obtained, and assembly workability can be further improved.

Modified Exemplary Embodiment 3

Figure 8:
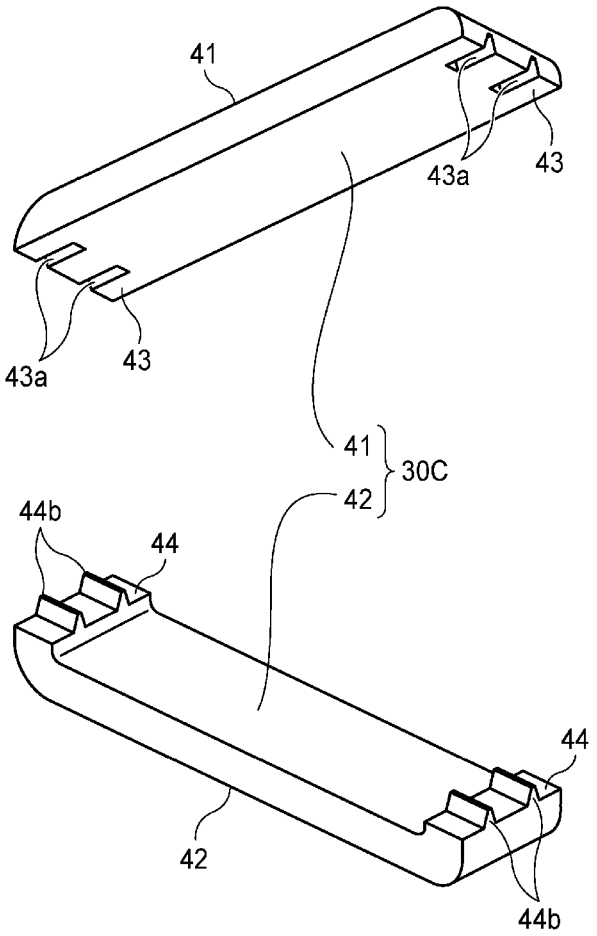
FIG. 8 is an exploded perspective view illustrating an annular core according to a modified exemplary embodiment 3.
Figure 9:
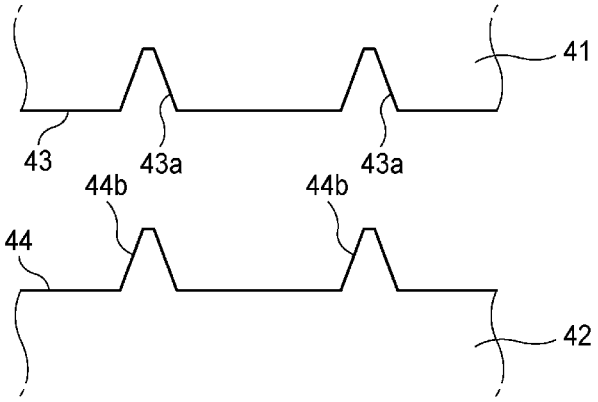
FIG. 9 is a side view illustrating split cores of the annular core according to a modified exemplary embodiment 3 when seen from an end surface side.

FIG. 8 is an exploded perspective view illustrating an annular core according to Modified Exemplary Embodiment 3. FIG. 9 is a side view illustrating split cores of the annular core according to Modified Exemplary Embodiment 3 when seen from an end surface side.

As illustrated in FIGS. 8 and 9, in an annular core 30C according to Modified Exemplary Embodiment 3, recess portions 43*a* formed of a groove is formed on each of the joining surfaces 43 of the one 41 of the split cores, and projection portions 44*b* formed of a ridge is formed on each of the joining surfaces 44 of the other 42 of the split cores. Each of the recess portions 43*a* has a tapered shape that becomes gradually narrower to a bottom portion, and each of the projection portions 44*b* has a tapered shape that becomes gradually narrower in a protruding direction.

In the annular core 30C according to Modified Exemplary Embodiment 3, by bringing the split cores 41, 42 into contact with each other, the recess portions 43*a* of the joining surfaces 43 and the projection portions 44*b* of the joining surfaces 44 are fitted to each other such that the split cores 41, 42 are aligned. Here, each of the recess portions 43*a* has a tapered shape that becomes gradually narrower to a bottom portion, and each of the projection portions 44*b* has a tapered shape that becomes gradually narrower in a protruding direction. Therefore, the projection portions 44*b* are guided and fitted to the recess portions 43*a*. As a result, the split cores 41, 42 can be easily and accurately aligned.

The present invention is not limited to the above examples of exemplary embodiments. It is apparent that the respective configurations of the examples of the exemplary embodiments may be combined or may be modified and applied by those skilled in the art based on the description of the specification and well-known techniques. The combinations, modifications, and applications are included in the scope of the invention.

For example, in the examples of the Modified Exemplary Embodiment 1 to 3, the recess portions 43*a* are provided on the joining surfaces 43 of the both ends of the one 41 of the split cores, and the projection portions 44*b* are provided on the joining surfaces 44 of the both ends of the other 42 of the split cores. However, the projection portions 43*b* may be provided on the joining surfaces 43 of the both ends of the one 41 of the split cores, and the recess portions 44*a* to which the projection portions 43*b* are fitted may be provided on the joining surfaces 44 of the both ends of the other 42 of the split cores. Further, the recess portion 43*a* may be provided on the joining surface 43 of one end of the one 41 of the split cores, the projection portion 43*b* may be provided on the joining surface 43 of the other end of the one 41 of the split cores, the projection portion 44*b* that is fitted to the recess portion 43*a* may be provided on the joining surface 44 of one end of the other 42 of the split core, and the recess portion 44*a* to which the projection portion 43*b* is fitted may be provided on the joining surface 44 of the other end of the other 42 of the split cores.

In accordance with a first aspect of the exemplary embodiments, a noise filter 10 includes at least one conductor 20 including a wound portion 21, and an annular core (30, 30A, 30B, 30C) formed of a magnetic material. The annular core (30, 30A, 30B, 30C) passes through the wound portion 21 in a first direction. The annular core 30, 30A, 30B, 30C includes a first split core 41 and a second split core 42. The first split core 41 includes a first joining surface 43 in one end of the first direction and a second joining surface 43 in the other end of the first direction. The second split core 42 includes a third joining surface 44 in the one end of the first direction and a fourth joining surface 44 in the other end of the first direction. The first split core 41 and the second split core 42 are assembled together by joining the first joining surface 43 and the third joining surface 44 to each other and joining the second joining surface 43 and the fourth joining surface 44 to each other. The first joining surface 43 includes one of a recess portion and a projection portion and the third joining surface 44 includes the other of the recess portion and the projection portion, and the one of the recess portion and the projection portion of the first joining surface 43 and the other of the recess portion and the projection portion of the third joining surface 44 engage with each other. The second joining surface 43 includes one of a recess portion and a projection portion and the fourth joining surface 44 includes the other of the recess portion and the projection portion, and the one of the recess portion and the projection portion of the second joining surface 43 and the other of the recess portion and the projection portion of the fourth joining surface 44 engage with each other.

According to the structure of the first aspect, by engaging the recess portion and the projection portion of the joining surfaces of the split cores with each other, the split cores would be easily aligned and joined to each other to form the annular core. As a result, deterioration of impedance characteristic caused by misalignment of the joining surfaces would be suppressed, a satisfactory noise reduction effect would be obtained, and assembly workability would be improved.

In accordance with a second aspect of the exemplary embodiments, in the noise filter 10 of the first aspect, at least one of the first split core 41 and the second split core 42 may have a linear shape. A plurality of the conductor portions may be aligned in the first direction. The one of the first split core 41 and the second split core 42 having the linear shape may pass through the wound portions 21 of the conductors 20.

According to the structure of the second aspect, the split cores are assembled together in a state where the split core formed to be linear passes through the wound portions of the plural conductors. As a result, the plural conductors would be easily mounted on the annular core, and assembly workability would be further improved. Further, the noise filter has the structure in which the plural conductors are arranged in a row in the linear split core. Therefore, a reduction in height would be realized, and the noise filter would be provided in a narrow space.

In accordance with a third aspect of the exemplary embodiments, in the noise filter of the first aspect or the second aspect, the recess portion and the projection portion of the first joining surface 43 and the third joining surface 44 may be formed of a groove and a ridge that engage with each other. The recess portion and the projection portion of the second joining surface 43 and the fourth joining surface 44 may be formed of a groove and a ridge that engage with each other. A second direction in which the groove and the ridge of the first joining surface 43 and the third joining surface 44 extends and a third direction in which the groove and the ridge of the second joining surface 43 and the fourth joining surface 44 extends may be different from each other.

According to the structure of the third aspect, the split cores are aligned in plural directions by the recess portion and the projection portion that engage with each other on the joining surfaces of the both ends of the split cores. Accordingly, the split cores would be aligned with higher accuracy, a satisfactory noise reduction effect would be obtained, and assembly workability would be further improved.

In accordance with a fourth aspect of the exemplary embodiments, in the noise filter of the first aspect or the second aspect, the one of the recess portion and the projection portion of the first joining surface 43 may include one of a hole and a protrusion. The other of the recess portion and the projection portion of the third joining surface 44 may include the other of the hole and the protrusion that engages with the one of the hole and the protrusion.

According to the structure of the fourth aspect, by engaging the projection portion formed of a protrusion with the recess portion formed of a hole, the split cores would be aligned with higher accuracy, a satisfactory noise reduction effect would be obtained, and assembly workability would be further improved.

In accordance with a fifth aspect of the exemplary embodiments, in the noise filter of any one of first to fourth aspects, the recess portion may have a tapered shape that becomes gradually narrower toward a bottom portion, and the projection portion may have a tapered shape that becomes gradually narrower in a protruding direction.

According to the structure of the fifth aspect, in a case where the joining surfaces are joined to each other, the projection portion is guided and fitted to the recess portion. As a result, the split cores would be easily and accurately aligned.

In accordance with a sixth aspect of the exemplary embodiments, in the noise filter of any one of the first to fifth aspects, the first joining surface 43 and the third joining surface 44 may be adhered and fixed to each other by a magnetic adhesive member.

According to the structure of the sixth aspect, an annular and continuous magnetic path would be reliably formed by fixing the joining surfaces of the split cores to each other using the magnetic adhesive member, and a satisfactory noise reduction effect would be obtained. In addition, even in a case where the adhesive member having fluidity is used, the adhesive member remains in the recess portion of the joining surface. Therefore, the joining operation of the split cores would be easily performed.

In accordance with a seventh aspect of the exemplary embodiments, a noise reduction unit may include a housing 81 in which the noise filter 10 of any one of the first to sixth aspects is accommodated. An electric wire 1 of a wire harness routed into the housing 81 may be electrically connected to the conductor 20.

According to the structure of the seventh aspect, noise generated by high-speed switching in the inverter would be satisfactorily reduced. In addition, the noise filter in which the height is suppressed is accommodated in the housing. As a result, a reduction in height would be realized, and the noise reduction unit would be provided in a narrow space. Thus, the noise reduction unit can be fixed to a floor panel of a vehicle by being attached to a portion in the middle of a wire harness of the vehicle or the like. In addition, the noise filter including the annular core formed of a magnetic material would be protected by the housing.

According to one or more embodiments, a noise filter capable of obtaining a satisfactory noise reduction effect and having excellent assembly workability, and a noise reduction unit including the noise filter would be provided.

What is claimed is:

1. A noise filter comprising:

at least one conductor including a wound portion; and an annular core formed of a magnetic material, wherein the annular core includes a first split core and a second split core, wherein only one of the first split core and the second split core passes through the at least one conductor including the wound portion, and wherein the other of the first split core and the second split core does not pass through any wound portion of any conductor, wherein the first split core includes a first joining surface at one end, in a first direction, a second joining surface at the other end, in the first direction, and a first body portion disposed between the first joining surface and the second joining surface in the first direction, wherein the second split core includes a third joining surface at the one end, in the first direction, a fourth joining surface at the other end, in the first direction, and a second body portion disposed between the third joining surface and the fourth joining surface in the first direction, wherein the first body portion and the second body portion form a space therebetween in a second direction perpendicular to the first direction, the wound portion being wound around at least one of the first body portion and the second body portion, wherein the first split core and the second split core are assembled together by joining the first joining surface and the third joining surface to each other and joining the second joining surface and the fourth joining surface to each other, the first joining surface facing the third joining surface in the second direction when assembled, wherein the first joining surface includes one of a plurality of recess portions and a plurality of projection portions and the third joining surface includes the other of the plurality of recess portions and the plurality of projection portions, and the one of the plurality of recess portions and the plurality of projection portions of the first joining surface and the other of the plurality of recess portions and the plurality of projection portions of the third joining surface engage with each other with the projection portions being configured for insertion into the recess portions in the second direction, and wherein the second joining surface includes one of a plurality of recess portions and a plurality of projection portions and the fourth joining surface includes the other of the plurality of recess portions and the plurality of projection portions, and the one of the plurality of recess portions and the plurality of projection portions of the second joining surface and the other of the plurality of recess portions and the plurality of projection portions of the fourth joining surface engage with each other with the projection portions being configured for insertion into the recess portions in the second direction.

2. The noise filter according to claim 1, wherein the one of the recess portion and the projection portion of the first joining surface includes one of a hole and a protrusion, respectively, and wherein the other of the recess portion and the projection portion of the third joining surface includes the other of the hole and the protrusion, respectively, that engages with the one of the hole and the protrusion.

3. The noise filter according to claim 1, wherein the recess portion has a tapered shape that becomes gradually narrower toward a bottom portion, and the projection portion has a tapered shape that becomes gradually narrower in a protruding direction.

4. The noise filter according to claim 1, wherein the first joining surface and the third joining surface are adhered and fixed to each other by a magnetic adhesive member.

5. The noise filter according to claim 1, wherein the first joining surface includes the projection portion and the third joining surface includes the recess portion, and wherein the projection portion of the first joining surface extends, in a direction away from the first joining surface, beyond an uppermost surface of the third joining surface forming a boundary of the recess portion of the third joining surface.

6. A noise reduction unit comprising a housing in which the noise filter according to claim 1 is accommodated, wherein an electric wire of a wire harness routed into the housing is electrically connected to the at least one conductor.

7. The noise reduction unit of claim 6, wherein a terminal of the at least one conductor is secured to the housing in the second direction.

8. A noise filter comprising:

a plurality of conductors, each of the conductors including a wound portion; and an annular core formed of a magnetic material, wherein the annular core passes through the wound portion in a first direction, wherein the annular core includes a first split core and a second split core, wherein the first split core includes a first joining surface at one end, in the first direction, and a second joining surface at the other end, in the first direction, wherein the second split core includes a third joining surface at the one end, in the first direction, and a fourth joining surface at the other end, in the first direction, wherein the first split core and the second split core are assembled together by joining the first joining surface and the third joining surface to each other and joining the second joining surface and the fourth joining surface to each other, wherein the first joining surface includes one of a plurality of recess portions and a plurality of projection portions and the third joining surface includes the other of the plurality of recess portions and the plurality of projection portions, and the one of the plurality of recess portions and the plurality of projection portions of the first joining surface and the other of the plurality of recess portions and the plurality of projection portions of the third joining surface engage with each other with the projection portions being configured for insertion into the recess portions, wherein the second joining surface includes one of a plurality of recess portions and a plurality of projection portions and the fourth joining surface includes the other of the plurality of recess portions and the plurality of projection portions, and the one of the plurality of recess portions and the plurality of projection portions of the second joining surface and the other of the plurality of recess portions and the plurality of projection portions of the fourth joining surface engage with each other with the projection portions being configured for insertion into the recess portions, and wherein at least one of the first split core and the second split core has a linear shape, wherein the plurality of conductors are aligned and spaced apart in the first direction, while only one of the at least one of the first split core and the second split core having the linear shape passes through the wound portions of the plurality of conductors, and wherein the other of the first split core and second split core does not pass through any wound portion of any conductor.

9. A noise filter comprising:

at least one conductor including a wound portion; and an annular core formed of a magnetic material, wherein the annular core includes a first split core and a second split core, wherein only one of the first split core and the second split core passes through the at least one conductor including the wound portion, and wherein the other of the first split core and the second split core does not pass through any wound portion of any conductor, wherein the first split core includes a first joining surface at one end, in the first direction, a second joining surface at the other end, in the first direction, and a first body portion disposed between the first joining surface and the second joining surface in the first direction, wherein the second split core includes a third joining surface at the one end, in the first direction, a fourth joining surface at the other end, in the first direction, and a second body portion disposed between the third joining surface and the fourth joining surface in the first direction, wherein the first body portion and the second body portion form a space therebetween in a second direction perpendicular to the first direction, the wound portion being wound around at least one of the first body portion and the second body portion, wherein the first split core and the second split core are assembled together by joining the first joining surface and the third joining surface to each other and joining the second joining surface and the fourth joining surface to each other, the first joining surface facing the third joining surface in the second direction when assembled, wherein the first joining surface includes one of a recess portion and a projection portion and the third joining surface includes the other of the recess portion and the projection portion, and the one of the recess portion and the projection portion of the first joining surface and the other of the recess portion and the projection portion of the third joining surface engage with each other with the projection portion being configured for insertion into the recess portion in the second direction, wherein the second joining surface includes one of a recess portion and a projection portion and the fourth joining surface includes the other of the recess portion and the projection portion, and the one of the recess portion and the projection portion of the second joining surface and the other of the recess portion and the projection portion of the fourth joining surface engage with each other with the projection portion being configured for insertion into the recess portion in the second direction, wherein the recess portion and the projection portion of the first joining surface and the third joining surface are formed of a groove and a ridge that engage with each other, wherein the recess portion and the projection portion of the second joining surface and the fourth joining surface are formed of a groove and a ridge that engage with each other, wherein the groove and the ridge of the first joining surface and the third joining surface extend in the second direction, and wherein a third direction in which the groove and the ridge of the second joining surface and the fourth joining surface extends is different from the second direction.

* * * * *